US010772804B2

(12) United States Patent
Hellenbrand

(10) Patent No.: US 10,772,804 B2
(45) **Date of Patent: *Sep. 15, 2020**

(54) METHOD FOR RELIABLY FILLING A TRANSPORT BOX HAVING A PLURALITY OF ACCOMMODATING COMPARTMENTS BY USING AN OUTPUT/INPUT STATION THAT SEQUENTIALLY PROVIDES MEDICAMENT PACKS FROM AN AUTOMATED STORAGE SYSTEM, AND OUTPUT/INPUT STATION THEREFOR

(71) Applicant: CareFusion Germany 326 GmbH, Kelberg (DE)

(72) Inventor: Christoph Hellenbrand, Kaifenheim (DE)

(73) Assignee: CareFusion Germany 326 GmbH, Kelberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/399,704

(22) Filed: Apr. 30, 2019

(65) Prior Publication Data

US 2019/0254929 A1 Aug. 22, 2019

Related U.S. Application Data

(63) Continuation of application No. 14/901,458, filed as application No. PCT/EP2014/062653 on Jun. 17, 2014, now Pat. No. 10,278,900.

(30) Foreign Application Priority Data

Jun. 26, 2013 (EP) ..... 13173753

(51) Int. Cl.
*A61J 7/00* (2006.01)
*G07F 17/00* (2006.01)
(Continued)

(52) U.S. Cl.
CPC ..... *A61J 7/0069* (2013.01); *B65B 5/103* (2013.01); *G07F 11/62* (2013.01);
(Continued)

(58) Field of Classification Search
CPC .. A61J 7/0069; A61J 2205/10; A61J 2205/60; G07F 11/61; G07F 17/0092; G07F 11/62; B65B 5/103
(Continued)

(56) References Cited

U.S. PATENT DOCUMENTS 4,847,764 A 7/1989 Halvorson
6,318,051 B1 * 11/2001 Preiss ..... B65B 5/103 53/237
(Continued)

FOREIGN PATENT DOCUMENTS

DE 102008027646 A1 12/2009
EP 2092927 A1 8/2009
(Continued)

OTHER PUBLICATIONS

International Preliminary Report on Patentability dated Jan. 7, 2016 in PCT/EP2014/062653 (11 pages).
(Continued)

*Primary Examiner* — Michael Collins
(74) *Attorney, Agent, or Firm* — Morgan, Lewis & Bockius LLP

(57) ABSTRACT

A method for filling a tray with individual medicine portions, which are removed from medicament packs that are provided from an automated storage system by means of an output/input station, is provided. A target filling of accommodating compartments of the tray is provided to a control device, which determines the medicament packs to be removed from storage and the sequence of the removal. For removal, a medicament pack is placed on a first transfer
(Continued)

position of the output/input station by an operating device, transported to an output position by a first transport device as soon as the output position is free, and removed from the output position. Individual portions are removed from the medicament pack and introduced into respective accommodating compartments of the tray as indicated by an indicating device. The medicament pack is transported to a second transfer position by a second transport device.

19 Claims, 4 Drawing Sheets

(51) Int. Cl.
*G07F 11/62* (2006.01)
*B65B 5/10* (2006.01)

(52) U.S. Cl.
CPC ..... *G07F 17/0092* (2013.01); *A61J 2205/10* (2013.01); *A61J 2205/60* (2013.01)

(58) Field of Classification Search
USPC ..... 700/231–244
See application file for complete search history.

(56) References Cited

U.S. PATENT DOCUMENTS

| | | | | |
|---|---|---|---|---|
| 7,779,614 | B1 | 8/2010 | McGonagle | |
| 7,856,794 | B2 * | 12/2010 | Zieher | B65B 5/103 53/246 |
| 8,380,346 | B2 * | 2/2013 | Chudy | G06F 19/3462 700/242 |
| 9,002,510 | B2 | 4/2015 | Chudy | |
| 9,355,222 | B2 | 5/2016 | Chudy | |
| 9,477,816 | B2 | 10/2016 | Dent | |
| 10,278,900 | B2 * | 5/2019 | Hellenbrand | A61J 7/0069 |
| 2003/0105552 | A1 | 6/2003 | Lunak | |
| 2006/0016824 | A1 * | 1/2006 | Guerra | B65G 1/04 221/92 |
| 2007/0109951 | A1 | 5/2007 | Vernois | |
| 2008/0051937 | A1 | 2/2008 | Khan | |
| 2009/0039040 | A1 | 2/2009 | Johnson | |
| 2009/0120042 | A1 | 5/2009 | Zieher | |
| 2009/0138122 | A1 | 5/2009 | Wagner | |
| 2009/0152291 | A1 | 6/2009 | Ohmura | |
| 2010/0249997 | A1 * | 9/2010 | Greyshock | G07F 11/54 700/240 |
| 2013/0218330 | A1 | 8/2013 | Chudy | |

FOREIGN PATENT DOCUMENTS

| | | | |
|---|---|---|---|
| EP | 2255774 | A1 | 12/2010 |
| EP | 2574574 | A1 | 4/2013 |
| JP | H01226501 | A | 9/1989 |
| JP | H11206853 | A | 8/1999 |

OTHER PUBLICATIONS

Japanese Office Action for Application No. 2016-522389, dated Apr. 10, 2018, 21 pages.

* cited by examiner

METHOD FOR RELIABLY FILLING A TRANSPORT BOX HAVING A PLURALITY OF ACCOMMODATING COMPARTMENTS BY USING AN OUTPUT/INPUT STATION THAT SEQUENTIALLY PROVIDES MEDICAMENT PACKS FROM AN AUTOMATED STORAGE SYSTEM, AND OUTPUT/INPUT STATION THEREFOR

CROSS-REFERENCE TO RELATED APPLICATION

This application is a continuation of U.S. patent application Ser. No. 14/901,458, filed on Dec. 28, 2015, entitled: "METHOD FOR RELIABLY FILLING A TRANSPORT BOX HAVING A PLURALITY OF ACCOMMODATING COMPARTMENTS BY USING AN OUTPUT/INPUT STATION THAT SEQUENTIALLY PROVIDES MEDICAMENT PACKS FROM AN AUTOMATED STORAGE SYSTEM, AND OUTPUT/INPUT STATION THEREFOR," now U.S. Pat. No. 10,278,900, issued May 7, 2019, which is a U.S. National Phase under 35 U.S.C. § 371 of International Application No. PCT/EP2014/062653, filed on Jun. 17, 2014, which claims the benefit of EP13173753.8, filed on Jun. 26, 2013. The entire contents of these applications are incorporated by reference herein.

BACKGROUND OF THE INVENTION

The invention relates to a method for filling an open transport box (tray) having a plurality of receiving compartments with individual portions of medicaments. Moreover, the invention relates to an output/input station for an automated storage system for medicament packs for use in a method for filling an open transport box (tray) having a plurality of receiving compartments with individual portions of medicaments.

Flat transport boxes (also referred to as trays) having a plurality of receiving compartments which are open at the top and arranged next to one another, preferably in rows and columns in matrix form, are used, for example, for the ordered supplying of selectively specified quantities of individual portions of medicaments, for example individual (or even halved) tablets or capsules, to a blister packaging machine for producing blister packs for individual patients, i.e., for automatically filling and packaging medicament dosages in individual small film bags or pockets.

Such a blister packaging machine customarily has a plurality of storage containers (for example, 50 or even several hundred), each containing large quantities of medicament portions, such as tablets or capsules, of frequently needed medicaments. One example of such a blister packaging machine is the "Rowa Dose System" by the present applicant (see http://www.rowa.de/Rowa-Dose.1072.0.html). The medicament portions provided in the storage containers are automatically individually removed in a specified number by means of computer-controlled dosing devices, and guided via slides and chutes into collection bins, each collection bin collecting the medicament portions to be filled into a bag or a pocket. The collection bins are led in succession to a packaging station, where they are initially emptied into small film bags or pockets which are still open, whereupon the bags or pockets are closed, in particular their film edges being welded. Each bag then contains the contents collected in the collection bin, which include, for example, the medicament to be taken by a patient at a specified time. The dosage time may also be printed on the bag.

In order to also be able to introduce medicament portions which are to be dispensed less frequently and are not provided in the storage containers, or also half tablets, for example, into the collection bins and thus into the bags (blisters), such a blister packaging machine has a device for which such less frequent medicaments or also partial portions (half tablets, for example) may be selectively introduced fully automatically into specified collection bins. This device is provided with the medicament portions in the above-mentioned open transport boxes (trays) in an ordered manner. For controlling this device, the control computer must know exactly which individual medicament portions are provided in which receiving compartments of the open transport box (tray). For this purpose, it is in turn necessary for the manual filling of the trays to be monitored in such a way that the correct receiving compartments are filled with the specified medicament portions according to a target filling. Errors during manual filling may occur in particular when the workstation of the operator performing filling is simultaneously provided with multiple medicament storage packs, from which the operator then removes the required number of individual portions in succession and places them in specified receiving compartments of the tray. It is possible here, for example, for the operator to inadvertently reach into the wrong medicament storage pack.

The object of the invention, therefore, is to provide a method for filling the trays which increases the reliability of correct filling, and a device which supports such reliable filling. In addition, the aim is to simplify and assist with manual filling.

This object is achieved according to the invention by a method for filling an open transport box (tray) having a plurality of receiving compartments with individual portions of medicaments, having the features of claim 1, and by an output/input station for an automated storage system for medicament packs for use in a method for filling an open transport box (tray) having a plurality of receiving compartments with individual portions of medicaments, having the features of claim 8.

In the method for filling an open transport box (also referred to as a tray) having a plurality of receiving compartments, preferably open at the top, with individual portions of medicaments (tablets and capsules, for example), in which the individual portions are removed from medicament packs (standard blister boxes or bottles, for example) which are provided by an automated storage system (an automated picking machine, for example), using an output/input station, firstly, (a) a control device (a control computer or a computer network, for example) is provided with a target filling of the receiving compartments of the transport box, from which the medicament packs to be removed from storage and a sequence of their removal from storage are determined (this may be carried out in advance or also continuously, depending on the availability of the packs and additional removal operations which take place in parallel). The target filling includes information concerning which medicament portions are to be inserted into the individual receiving compartments. Then, (b) a medicament pack which contains at least one individual portion of a specified medicament (i.e., a medicament pack that is complete or only partially filled) is removed from the automated storage system, in that the medicament pack is deposited on a first receiving site of the output/input station by an operator unit (a computer-controlled gripper robot, for example) of the automated storage system, and is transported to an output site by a first transport device as soon as the output site is free. Then, (c) the medicament pack is removed from the output site of the output/input station (preferably by an operator), and (d) one or more individual portions are removed from the removed medicament pack (preferably by the operator) and introduced in each case into one or more specified receiving compartments of the transport box, whereby one or more medicament portions may be inserted into each receiving compartment. The particular receiving compartment to be filled is displayed to the user by means of a display device controlled by the control device (for example, by optical and/or acoustic output of the coordinates or a position description of the receiving compartment by means of an output device of a computer, or by activating a display situated immediately next to the compartment, or by directing a light spot onto the particular compartment, etc.). In addition, the correct filling of the individual portions is monitored by the control device (for example, by proximity sensors situated on each compartment, or by computer-assisted analysis of an electronic image recorded by the tray). Subsequently, (e) the medicament pack, provided that it is partially emptied (for example, still containing at least one individual portion, whereby even higher minimum numbers may be specified), is deposited on a restocking site of the output/input station which is situated in close proximity to the output site (i.e., preferably in the access area of the same operator), and from there is transported to a second receiving site by means of a second transport device, and is accessed by the operator unit (a gripper robot, for example) of the automated storage system in order to restock the ("broken") medicament pack in the automated storage system (whereby the control device of the storage system stores information concerning the partial emptying of the medicament pack). Lastly, (f) the steps (b) through (e) are repeated for each subsequent medicament pack until all individual portions have been filled according to the target allocation.

This procedure of the automated sequential removal from and return to storage of always only one medicament storage pack in combination with the monitored removal and insertion into the tray compartments has the advantage that removal from the wrong medicament storage packs and incorrect loading of the compartments are avoided.

One preferred embodiment of the method is characterized in that an identification affixed to the medicament pack, for example a barcode or an RFID, is read in step (b) in order to check the correctness of the removed medicament pack. This provides additional reliability.

In addition, an identification affixed to the medicament pack, for example a barcode or an RFID, is preferably read in step (d) prior to or during depositing in order to check the correctness of the medicament pack to be restocked. This also provides additional reliability, since the correctness of the pack be restocked, and thus of the operator's actions, may be checked.

One refinement of the method according to the method is characterized in that a signal which brings about the transport of the subsequent medicament pack to the output site is generated, either during removal of a medicament pack from the output site, after filling of a receiving compartment with the last individual portion removed from a medicament pack, or after placing the partially emptied medicament pack on the restocking site of the output/input station. For example, the signal which brings about the transport of the subsequent medicament pack to the output site is generated by activating an operator input device. In one alternative embodiment, the signal which brings about the transport of the subsequent medicament pack to the output site is generated by the signal which brings about the transport of the subsequent medicament pack to the output site (6).

Another refinement of the method according to the method is characterized in that the placement of a medicament pack on the restocking site is detected by triggering a further sensor, for example a photoelectric barrier. This allows automatic triggering of the further transport of the pack to be returned to storage by the second transport device, and an early clearing of the restocking site for a subsequent restocking.

The output/input station according to the invention for an automated storage system for medicament packs for use in a method for reliably filling an open transport box (tray) having a plurality of receiving compartments with individual portions of medicaments has a first transport device, a second transport device, and a control device. The first transport device may receive a medicament pack from an operator unit of the automated storage bay at a first receiving site and transport it to an output site, at which the medicament pack is available for access by an operator. Drive devices or regulating devices (motors or actuators, for example) of the first transport device drive means (conveyor belts, for example) for transporting the medicament pack and/or enabling such transport (for example, blocking at the upper end of a chute or a slide) and/or for enabling access to the output site (doors, for example). The second transport device may receive a medicament pack at a restocking site which is accessible to an operator and transport it to a second receiving site in the access area of the operator unit, whereby drive devices or regulating devices of the second transport device drive means for transporting the medicament pack and/or for enabling such transport. The restocking site is situated in close proximity to the output site. The control device (a control computer, for example) is coupled to the drive devices or regulating devices of the two transport devices and connected to a detection device for detecting a removal of a medicament pack from the output site, whereby after detecting the removal of a medicament pack from the output site, the control device causes a next medicament pack to be transported to the output site, provided that the medicament pack is already present in the first transport device; otherwise, the operator unit causes, in advance, the medicament pack to be removed from storage and provided to the first receiving site.

The output/input station according to the invention allows an automated sequential removal from and return to storage of always only one medicament storage pack, with the advantage that removal from the wrong medicament storage packs is avoided.

In one preferred embodiment of the output/input station, the drive devices or regulating devices of the first transport device drive means for enabling transport, and the means for enabling include an access block, situated between the first receiving site and the output site, which prevents further transport of a medicament pack to the output site until the control device enables this transport. This increases the reliability of the sequential output of the medicament packs. In this embodiment, it is preferably provided that the access block is an air lock with an airlock door on the inlet side and an airlock door on the output side. It is thus possible to operate the output/input station in such a way that the space containing the output site is always separate from the space containing the receiving site. The first transport device of the output/input station is preferably situated in a tunnel which passes through a wall between the automated storage system for medicament packs and a clean room, and the air lock closes the tunnel via the airlock door on the inlet side and via the airlock door on the output side. This allows a dust-tight separation of a clean room, containing the output site, from the space of the automated storage bay in which the operator unit moves.

In one embodiment, an identification device which allows reading of an identification affixed to the medicament pack is provided at the output site and/or at the restocking site. This provides additional reliability by checking the correctness of the type of medicament pack that is present at the output site or at the restocking site.

In one preferred embodiment of the output/input station, the first transport device is a first belt conveyor having a first conveyor belt and a drive, and the first receiving site and the output site are sites on the first conveyor belt. This simplifies the structural design, since the transport means itself provides the deposit surfaces for the receiving site and the output site. In addition, the second transport device is preferably a second belt conveyor having a second conveyor belt and a drive, and the restocking site and the second receiving site are sites on the second conveyor belt. In this embodiment, the first and the second conveyor belts are preferably situated in parallel next to one another and have approximately the same length. The parallel arrangement of flat belts operated in opposite directions simplifies the structural design and allows a compact design. The first receiving site and the second receiving site are then situated in a plane and directly next to one another, which simplifies the control and configuration of the operator unit which accesses them.

In one preferred refinement of the output/input station according to the invention, the first and the second conveyor belts are each situated in a tunnel which passes through a wall between the automated storage system for medicament packs and a clean room, in each case an air lock closing the tunnel via an airlock door on the inlet side and via an airlock door on the output side. This embodiment combines the mentioned advantages of the parallel belt arrangement with those of the airlock configuration.

Advantageous and/or preferred exemplary embodiments of the invention are characterized in the subclaims.

BRIEF DESCRIPTION OF THE DRAWINGS

The invention is described in greater detail below with reference to one preferred exemplary embodiment which is illustrated in the drawings, which show the following.

DETAILED DESCRIPTION

Figure 1:
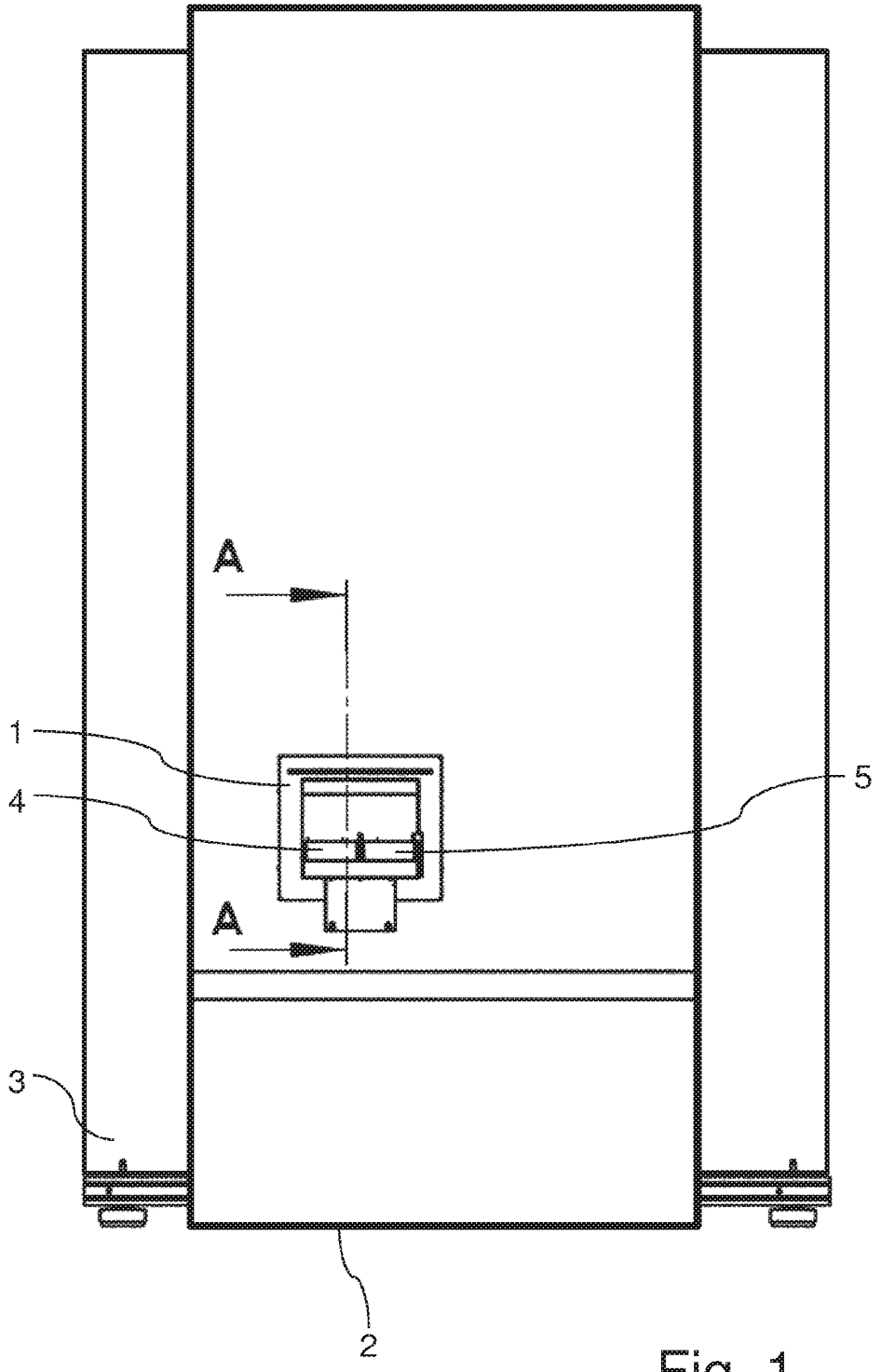
FIG. 1 shows a schematic front view of one exemplary embodiment of the output/input station according to the invention, with an output site and a restocking site situated next to one another.
Figure 2:
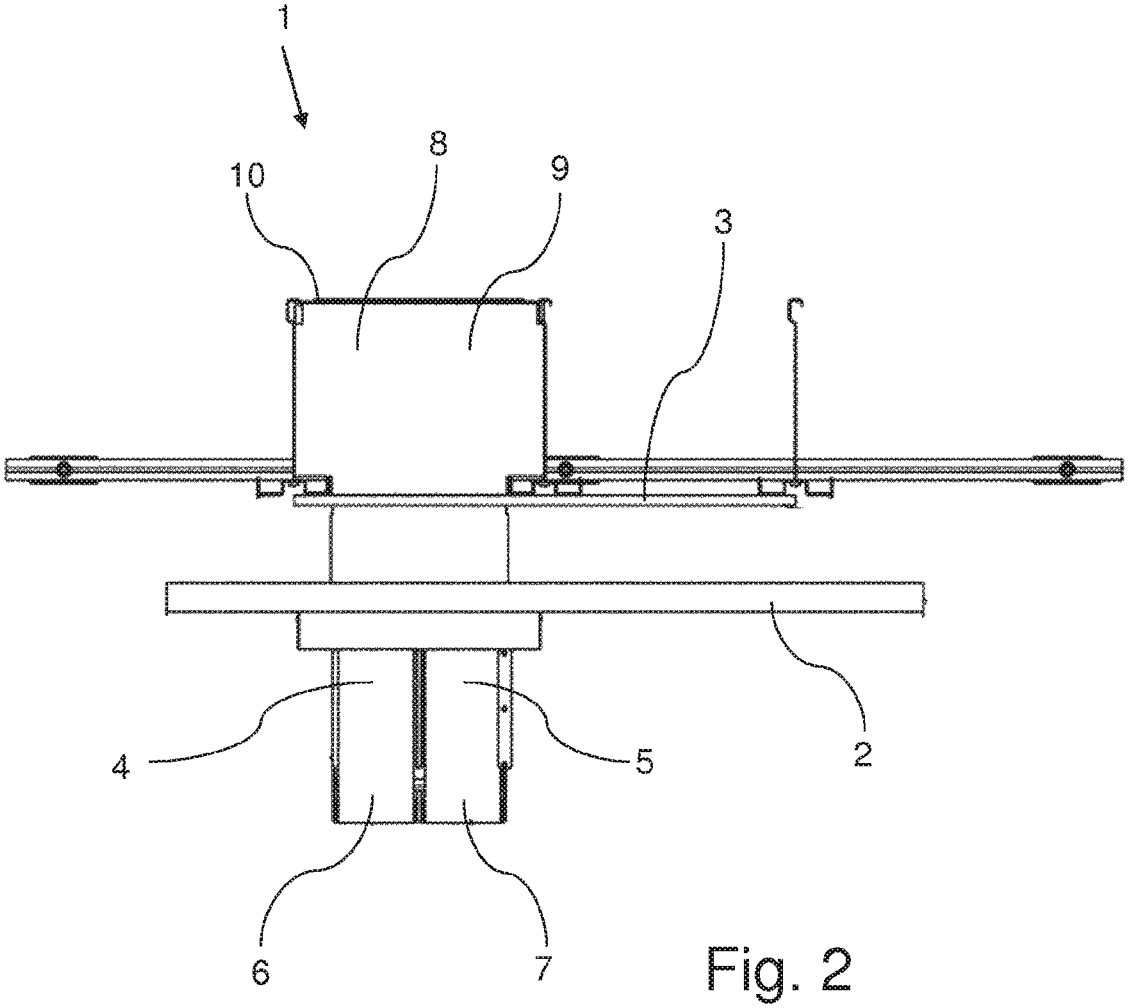
FIG. 2 shows a schematic top view of the exemplary embodiment of the output/input station according to the invention shown in FIG. 1.
Figure 3:
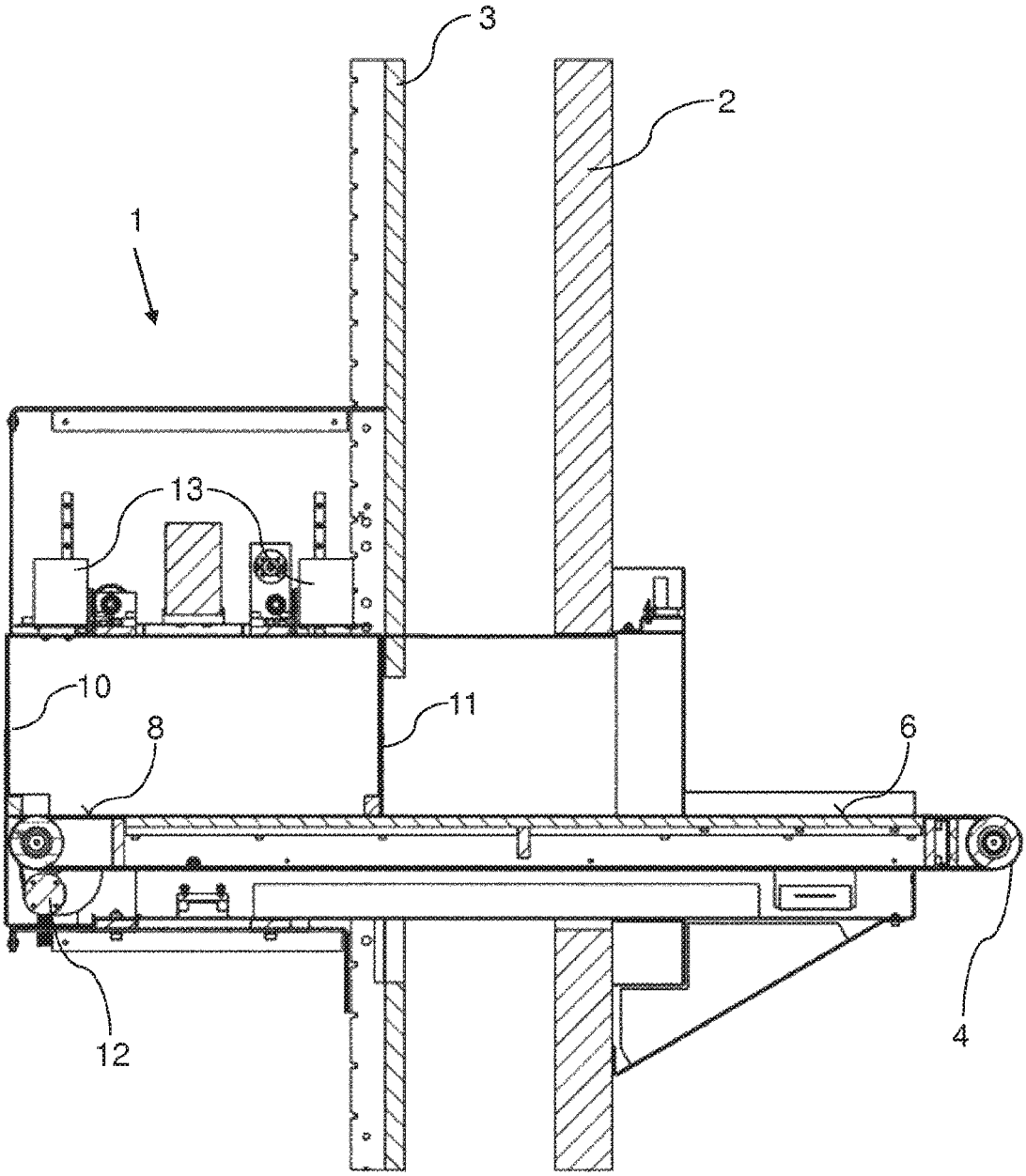
FIG. 3 shows a schematic sectional view of the output/input station shown in FIG. 1, along the line A-A.

FIGS. 1 through 3 show schematic views of one exemplary embodiment of the output/input station 1 according to the invention of an automated storage system for medicament packs. The output/input station 1 has transport devices for outputting medicament packs removed form the storage system, and for restocking medicament packs in the storage system, the transport devices being passed through a wall 3 of a housing or a covering of the automated storage system (automated picking machine), and through a wall 2, to a clean room. The medicament packs removed from storage, as storage containers for medicament portions in the clean room, are provided to an operator, who removes successive tablets or capsules (medicament portions) from these medicament packs and manually inserts them, deblistered, for example, into receiving compartments of an open transport box (tray) having a plurality of such receiving compartments. This filling of the trays takes place in a clean room so that preferably few dirt particles pass into the receiving compartments of the tray.

FIG. 1 shows a schematic top view of the front side of the output/input station 1 on the clean room side. The output/input station 1 includes a channel, accommodating the transport devices, which is situated in an opening in the wall 2 and in an opening in the outer wall 3 of the automated picking machine. Apparent in FIG. 1 is the rectangular channel which contains two conveyor belts 4 and 5 situated next to one another (the front sides of the conveyor belts on the deflection rollers are apparent in the figure).

FIG. 2 shows a schematic top view of the output/input station 1. The wall 2 separates the clean room, illustrated beneath the wall 2 in FIG. 2, from the space which accommodates the automated picking machine, illustrated above the wall 2 in FIG. 2. The conveyor belts 4 and 5 on the clean room side are apparent, whereby the medicament packs resting on the conveyor belt 4 are transported from a first receiving site 8 within the housing of the automated picking machine to an output site 6 on the clean room side, while the medicament packs [resting on] the conveyor belt 5, which have been placed on a restocking site 7 on the clean room side, are transported to a second receiving site 9 within the housing of the automated picking machine. An operator unit (not illustrated) of the automated picking machine, in particular a gripper robot, on the one hand may deposit individual medicament packs on the first receiving site 8 on the first conveyor belt 4, and on the other hand may receive medicament packs from the second receiving site 9 on the second conveyor belt 5. The two conveyor belts 4 and 5 are situated next to one another in parallel at the same height, and may be moved independently of one another in opposite directions. On the side of the interior of the automated picking machine, the conveyor belts 4 and 5 are covered by a housing which lies closely against the recess in the wall 2. In addition, the channel of the output/input station 1, in which the conveyor belts 4 and 5 are situated, is provided with an air lock, so that the clean room may be separated from the space of the picking robot. For each of the two conveyor belts 4 and 5, there is an airlock gate on the side of the picking robot and an airlock gate facing the clean room. In addition, a partition which subdivides the channel is situated between the conveyor belts 4 and 5. An airlock gate situated at the front side inside the picking robot is denoted by reference numeral 10 in FIG. 2.

FIG. 3 shows a schematic sectional view of the output/input station 1 along the line A-A according to FIG. 1. It is apparent here that the output/input station 1 includes a control device situated in the interior of the housing 3 of the automated picking machine, and therebeneath, a transport channel which accommodates the conveyor belts (the conveyor belt 4 is shown), the transport channel initially passing through an opening in the wall 3 of the automated picking machine and then through a recess in the wall 2 to the clean room. The conveyor belt 4 is driven by a drive motor 12. The deflection rollers are apparent at the ends of the conveyor belt. On the top side of the conveyor belt 4, the first receiving site 8 is situated on the clean room side of the deposit site 6 and, within an airlock chamber, on the side of the automated picking machine. Two airlock gates 10 and 11 close the channel above the conveyor belt 4. A first airlock gate 10 closes the airlock chamber on the side of the automated picking machine, and a second airlock gate 11 closes the airlock chamber on the output side to the clean room. The drives 13 for the airlock gates 10 and 11, among other elements, are situated in the installation space situated above the transport channel for accommodating control devices of the output/input station 1.

The workstation, not illustrated in the figures, for filling the trays is situated directly next to the deposit site 6 and the restocking site 7, so that the operator who is inserting medicament portions into the receiving compartments of the trays is able to access the output site 6 and the restocking site 7. Also situated at the output site 6 and at the restocking site 7 are readers (scanners, for example) with which identification means (barcodes, for example) affixed to the medicament packs may be read. During removal of a medicament pack from the output site 6, the user may check its identity, for example by scanning a barcode. Likewise, during placement of a medicament pack back on the restocking site 7, the operator may once again have its identifier (barcode, for example) read so that the control device can check the correctness of the pack to be restocked. The control device may thus check whether the operator has actually placed the medicament pack, previously removed from the output site 6 after removal of the medicament portions to be inserted into the receiving compartments of the tray, back on the restocking site 7. If this is not the case, the control device generates a warning signal and prompts for a correction before the output of subsequent medicament packs is initiated.

One preferred embodiment of the method according to the method for filling an open transport box (tray) having a plurality of receiving compartments with individual portions of medicaments is described below with reference to FIG. 4.

In a first step 20, data which describe a target filling of a tray with individual portions of medicaments are sent to the control computer of the automated picking machine. These data indicate, for example, in which receiving compartments which type of tablets or capsules are to be filled. The receiving compartments of the tray are preferably arranged in a matrix of rows and columns, and preferably include the data which characterize the target filling [and] the coordinates of these receiving compartments.

In step 21, the control computer subsequently determines a first pack to be removed from storage, based on the target filling. The selection of the first medicament pack may depend on the transport route and the storage location of the pack, or also on which type of medicament is to be stored in a first compartment of the matrix of receiving compartments of the tray. The control computer may also determine the complete sequence of the medicament packs to be removed from storage, based on the target filling, and then, by storing appropriate information in memories of the control computer provided for this purpose, may ensure that the medicament packs thus reserved cannot be removed from the storage system for other purposes.

In step 22, a first pack is subsequently removed from storage by the operator unit and deposited on the first receiving site 8. For this purpose, the airlock gate 10 is optionally opened beforehand on the side of the interior of the automated picking machine, and is once again closed after the first pack is deposited. A check is made in step 23 as to whether the deposit site 6 is free. When the first pack is output, this question is of course answered in the affirmative. During subsequent removals of further packs from storage, this query ensures that the conveyor belt 4 is not activated until the preceding medicament pack has been removed from the deposit site 6. It is checked in a subsequent query 24 whether a medicament pack from which the operator is to remove medicament portions and which has been removed from the deposit site 6 by the operator is still queued for restocking, i.e., for depositing on the restocking site 7, i.e., whether such a pack has not yet been deposited once again on the restocking site 7. If this question is answered in the affirmative, i.e., if a medicament pack previously removed from storage has not been placed on the restocking site, the control computer waits so that no further transport of the subsequent medicament pack deposited on the first receiving site 8 takes place.

However, if the question in step 24 is answered in the negative, i.e., the preceding medicament pack has already been deposited on the restocking site, the method continues with step 25, in which the medicament pack is transported from the first receiving site 8 to the deposit site 6. At that location, the medicament pack is then ready for removal by the operator.

Without waiting for the removal by the operator, the method continues with query step 26, in which it is checked whether the pack just transported to the deposit site is the last pack that is necessary for the target filling. If this is answered in the affirmative, the removal from storage and output to the deposit site terminates. However, if this is answered in the negative, the method returns to step 21, in which the subsequent pack to be removed from storage is determined. In the event that the sequence of the packs to be removed from storage has been determined beforehand, the next pack in the sequence is simply provided here for removal from storage. The method then continues once again with step 22, in which the subsequent pack is removed from the automated storage system by the operator unit and deposited on the first receiving site 8. A query is then once again made in step 23 as to whether the deposit site is free. This is answered in the negative, for example, when the operator has not yet removed the pack previously transported to the deposit site 6 in step 25.

The loops in the top half of the illustration in the figure ensure that provision is already made for transporting a subsequent pack to be removed from storage while the pack previously removed from storage is still on the deposit site 6. However, the conveyor belt 4 is not reactivated until the deposit site has been previously emptied by removing the pack.

Figure 4:
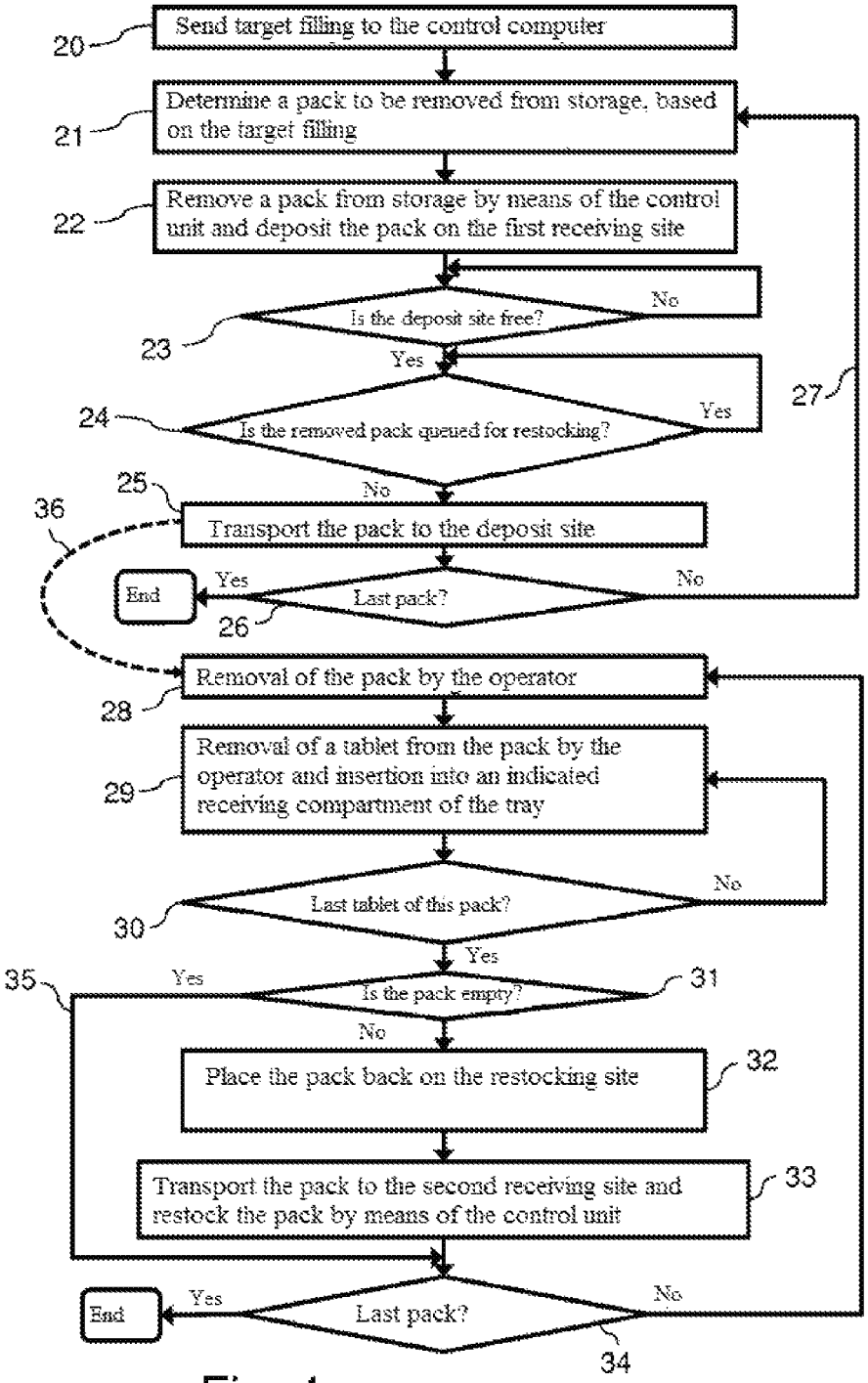
FIG. 4 shows a schematic illustration of the process sequence of one embodiment of the method according to the invention.

The sequence which begins with the removal of a pack from the deposit site 6 by the operator is illustrated in the bottom half of FIG. 4. This removal in step 28 is decoupled in terms of time from the transport step 25, as indicated by a dashed-line arrow 36. The removal of the pack in step 28 naturally takes place after the pack has been transported to the deposit site 6; however, an indeterminate period of time may elapse between the transport of the pack to the deposit site 6 and the removal of the pack.

In step 29, the operator removes a medicament portion, for example a tablet or capsule, from the medicament pack removed from the deposit site 6.

At the same time, the control computer displays to the operator the particular receiving compartment of the ready tray in which this medicament portion is to be inserted. Since the control computer monitors the transport as well as the removal of the specified medicament pack, and by means of sensors also monitors the filling of portions into the receiving compartments, at any point in time the control computer also knows into which receiving compartment of the tray the next medicament portion is to be inserted. As stated above, in the simplest case the particular receiving compartment of the tray may be displayed by a visual or acoustic output on a screen or by means of a speaker. However, the selected receiving compartment is preferably directly identified, for example by activating an optical display, visible to the operator, next to or below the receiving compartment. If the tray is in a specified orientation on a specified site, the display may also take place by directing a light spot onto the selected receiving compartment. The operator then inserts the medicament portion into the indicated receiving compartment of the tray, which in turn is detected by the control computer by means of a suitable sensor system.

In step 30, a query is made as to whether a further medicament portion from this removed medicament pack is to be inserted into the same or a different receiving compartment of the tray. If this is the case, step 29 is carried out once again.

When all medicament portions from the removed medicament pack to be inserted have been filled into the tray to be loaded, i.e., no further tablets are to be removed from this pack, the method continues with query 31. A query is made here as to whether the pack is empty. The control computer recognizes this automatically, since it tracks the particular filling level of the pack. In order to increase the reliability, it may also be provided that the operator makes an entry as soon as he/she determines that the medicament pack is empty. If a discrepancy between this entry by the operator and the filling level of the medicament pack tracked by the control computer is determined, an appropriate error signal may be output. The user may then be prompted to investigate the situation more closely.

If it is determined in step 31 that the pack is empty (arrow 35), in step 34 the method continues with the query as to whether the pack most recently removed from storage is the last pack required for the target filling. If this is the case, the method terminates. If this is not the case, it may be assumed that the process sequence illustrated in the top half of FIG. 4 has already ensured that the subsequent medicament pack has been transported to the deposit site 6. The process sequence in the bottom half of FIG. 4 then continues with step 28, namely, removal of the pack by the operator.

If it is determined in step 31 that the pack is not empty, the method continues with step 32, namely, with placement of the pack back on the restocking site 7. Multiple variants are likewise conceivable here. For example, due to the tracking of the filling level by the control computer, the user may be prompted to place the pack back on the restocking site, and optionally to have the barcode scanned. On the other hand, the user may always opt to place the pack back on the restocking site, this operation being detected by the control computer by means of suitable sensors. The control computer then checks whether the pack placed on the restocking site 7 is the correct pack.

The method then continues with step 33, in which the pack placed on the restocking site 7 is transported by the conveyor belt 5 to the second receiving site 9. In turn, the airlock gates are appropriately actuated. The operator unit of the automated storage system removes the pack (which has been partially emptied) from the second receiving site 9 and stores it at an appropriate site. Of course, the control computer also stores the filling level of the partially emptied pack in association with the storage site of this pack.

After step 33, the method continues once again with the query 34 described above. In alternative embodiments, step 34 and the subsequent steps may have already been carried out after it has been determined that the pack has been placed back on the restocking site 7 in step 32. Step 28 and optionally the subsequent steps 29 and 30 may already be carried out in this way during the return transport to the second receiving site and the restocking by the operator unit in step 33, which shortens the overall process. In this case, once again a query is to be provided, which avoids the situation in which a further medicament pack is placed back on the restocking site 7 before the pack previously placed there, on the second receiving site 9, has been removed by the operator unit.

Numerous alternative embodiments are conceivable within the scope of the inventive concept. Instead of situating the airlock gates on the side of the automated picking machine, these may be situated on the side of the clean room. For example, the output site 6 as well as the restocking site 7 may be completely surrounded by walls, and may be accessible by the operator only after the doors provided on the front side have been opened. Slides, for example, may also be used as a transport device instead of the conveyor belts, and blocks may be provided along the slides which may prevent or enable further sliding of the medicament packs. However, it is important that the output site 6 and the restocking site 7 are situated in close proximity to one another, i.e., are simultaneously accessible by the operator carrying out the filling of the trays.

What is claimed is:

1. A method for adding medicaments to a transport tray, the method comprising:

determining, by a control device, a medicament pack to be removed from an automatic storage system based on a target allocation;

depositing, by an operator unit of the automated storage system, the medicament pack on a first receiving site of an output/input station;

transporting, by a first transport device of the output/input station, the medicament pack to an output site through a tunnel having an air lock, the air lock closing the tunnel via an airlock door on an inlet side and via an airlock door on an output side;

placing a medicament portion from the medicament pack into a compartment of the transport tray;

placing the medicament pack on a restocking site of the output/input station;

transporting, by a second transport device, the medicament pack from the restocking site to a second receiving site; and depositing, by the operator unit, the medicament pack back into the automated storage system.

2. The method of claim 1, further comprising repeating the steps using one or more additional medicament packs until the transport tray has been filled according to the target allocation.

3. The method of claim 1, further comprising reading an identification affixed to the medicament pack to check the correctness of the removed medicament pack.

4. The method of claim 1, further comprising reading an identification affixed to the medicament pack to check the correctness of the medicament pack to be restocked.

5. The method of claim 1, further comprising generating a signal to cause transport of a subsequent medicament pack to the output site.

6. The method of claim 5, wherein the signal is generated at one of during removal of a medicament pack from the output site, after filling of a transport tray compartment with a last medicament from the medicament pack, and after placing the medicament pack on the restocking site of the output/input station.

7. The method of claim 5, wherein the signal is generated by activating an operator input device.

8. The method of claim 5, wherein the signal is generated by triggering a sensor.

9. The method of claim 1, wherein the placement of the medicament pack on the restocking site is detected by triggering a sensor.

10. The method of claim 1, wherein the transport tray compartment to be filled is displayed on a display device controlled by the control device.

11. The method of claim 1, wherein correct filling of the medicament is monitored by the control device.

12. The method of claim 1, wherein the determining of the medicament pack to be removed is based on one of a transport route, a storage location of the medicament pack and which type of medicament is to be stored in a particular compartment of the transport tray.

13. The method of claim 1, further comprising determining, by the control device, a complete sequence of medicament packs to be removed from storage based on the target allocation.

14. The method of claim 13, preventing, by the control device, the medicament packs identified by the complete sequence from being removed from the storage system for another purpose.

15. An output/input station for medicament packs, comprising:

a first transport device having one of a first drive device and a first regulating device, the first transport device configured to receive a first medicament pack from an automated storage system at a first receiving site and to transport the first medicament pack to an output site;

a second transport device having one of a second drive device and a second regulating device, the second transport device configured to receive the first medicament pack at a restocking site, wherein the restocking site is situated in close proximity to the output site, and to transport the first medicament pack to a second receiving site in an access area of the automated storage system;

a detection device configured to detect removal of the first medicament pack from the output site;

a control device coupled to the detection device and to one or more of the first and second drive and regulating devices, the control device configured to cause a second medicament pack to be transported to the output site when the first medicament pack is already present in the first transport device; and an air lock with an airlock door on an inlet side and an airlock door on an output side, wherein the first transport device is situated in a tunnel, and wherein the air lock is configured to close the tunnel via the airlock door on the inlet side and via the airlock door on the output side.

16. The output/input station of claim 15, wherein the air lock is an access block situated between the first receiving site and the output site, the access block configured to prevent further transport of the first medicament pack to the output site until the control device enables the transport.

17. The output/input station of claim 15, wherein the first transport device is a first belt conveyor having a first conveyor belt and a drive with the first receiving site and the output site on the first conveyor belt, and wherein the second transport device is a second belt conveyor having a second conveyor belt and a drive with the restocking site and the second receiving site on the second conveyor belt.

18. The output/input station of claim 17, wherein the first conveyor belt and the second conveyor belt are situated in parallel next to one another and have approximately the same length.

19. The output/input station of claim 18, wherein the first and the second conveyor belts are each situated in a tunnel, wherein in each case an air lock is configured to close the tunnel via an airlock door on an inlet side and via an airlock door on an output side.

* * * * *